US007497044B2

(12) United States Patent
Cammenga et al.

(10) Patent No.: US 7,497,044 B2
(45) Date of Patent: Mar. 3, 2009

(54) FIREARM MAGAZINE

(75) Inventors: Matt Cammenga, Zeeland, MI (US); John Cammenga, Zeeland, MI (US); Rob Austin, Holland, MI (US)

(73) Assignee: Cammenga Corporation, Holland, MI (US)

( * ) Notice: Subject to any disclaimer, the term of this patent is extended or adjusted under 35 U.S.C. 154(b) by 472 days.

(21) Appl. No.: 11/330,294

(22) Filed: Jan. 11, 2006

(65) Prior Publication Data

US 2007/0157501 A1 Jul. 12, 2007

(51) Int. Cl.
*F41A 9/65* (2006.01)

(52) U.S. Cl. ..... 42/50; 42/49.01

(58) Field of Classification Search ..... 42/87, 42/88, 90, 106, 49.01, 50, 22, 21, 49.02
See application file for complete search history.

(56) References Cited

U.S. PATENT DOCUMENTS

| | | | | | |
|---|---|---|---|---|---|
| 1,158,981 | A | | 11/1915 | Carl | |
| 1,797,951 | A | | 3/1931 | Gaidos | |
| 2,014,177 | A | | 9/1935 | Herlach et al. | |
| 2,137,491 | A | | 11/1938 | Huff | |
| 2,237,712 | A | | 4/1941 | Mullins | |
| 2,403,012 | A | | 7/1946 | McPheters | |
| 2,462,836 | A | | 3/1949 | Barker et al. | |
| 2,510,831 | A | * | 6/1950 | Patchett | 89/34 |
| 2,514,277 | A | | 7/1950 | Donallan | |
| 2,659,173 | A | | 11/1953 | Capito | |
| 2,773,325 | A | | 12/1956 | Hill | |
| 2,862,324 | A | | 12/1958 | Ball | |
| 2,882,635 | A | | 4/1959 | Hill | |
| 2,981,024 | A | | 4/1961 | Skoff | |
| 3,453,762 | A | * | 7/1969 | Fremont | 42/50 |
| 4,107,862 | A | * | 8/1978 | Sofinowski, III | 42/50 |
| 4,430,821 | A | | 2/1984 | Vincent | |
| 4,472,900 | A | * | 9/1984 | Howard | 42/50 |
| 4,614,052 | A | | 9/1986 | Brown et al. | |
| 4,688,344 | A | | 8/1987 | Kim | |
| 4,872,279 | A | | 10/1989 | Boat | |
| 4,995,179 | A | * | 2/1991 | Switzer | 42/50 |
| 5,081,778 | A | * | 1/1992 | Switzer | 42/50 |
| 5,113,605 | A | * | 5/1992 | Kim | 42/50 |
| 5,309,660 | A | | 5/1994 | Blackamore | |
| 5,357,703 | A | * | 10/1994 | Chesnut et al. | 42/50 |
| 5,402,594 | A | | 4/1995 | Switzer | |
| 5,438,783 | A | * | 8/1995 | Sniezak et al. | 42/7 |
| 5,461,811 | A | | 10/1995 | Ciener | |
| 6,678,985 | B2 | | 1/2004 | Pikula | |
| 6,698,127 | B2 | * | 3/2004 | Weber | 42/71.02 |

(Continued)

*Primary Examiner*—Michael Carone
*Assistant Examiner*—Benjamin P Lee
(74) *Attorney, Agent, or Firm*—Price, Heneveld, Cooper, DeWitt & Litton LLP

(57) ABSTRACT

A magazine for a firearm includes an elongated containing body and a closure member adapted to hold cartridges. The closure member longitudinally slides on the containing body and is extendable to open a side of the containing body for cartridge loading. The closure member has opposing sidewalls forming an integral handle surface that can be grasped for moving it. A follower and spring bias cartridges toward one end of the magazine. A latching mechanism is provided for holding the follower in a disengaged position when the closure member is extended, and is configured to release when the closure member is closed. Preferably, the containing body and closure member are constructed to include integrally formed features that cooperate with an automatic latching mechanism, thus minimizing parts.

19 Claims, 7 Drawing Sheets

U.S. PATENT DOCUMENTS 6,754,987 B1 * 6/2004 Cheng et al. ..... 42/87
6,807,764 B1 10/2004 Phillips
7,200,963 B1 * 4/2007 Vieweg ..... 42/49.01
7,200,964 B2 * 4/2007 Gates ..... 42/50
2003/0046854 A1 3/2003 Urchek
2005/0081421 A1 4/2005 Guy et al.
2005/0150148 A1 7/2005 Herpel
2005/0188579 A1 * 9/2005 Gates ..... 42/50
2008/0184608 A1 * 8/2008 Tal et al. ..... 42/87

* cited by examiner

FIREARM MAGAZINE

BACKGROUND

The present invention relates to firearms and cartridge magazines, and to methods of loading magazines.

Improvements are desired for the magazine disclosed in Brown U.S. Pat. No. 4,614,052. For example, improvements are desired to make loading of bullets into the magazine even easier and faster with the cover moved to a less obtrusive position. Further, it is desirable to construct the magazine of fewer parts, to eliminate protruding parts, and to provide a simplified overall assembly. Still further, it is desirable to provide a magazine that is more resistant to intrusion of dirt and debris, and to facilitate its loading even in conditions that are less than desirable, such as bad weather and/or dirty environments. Also, it is desirable to provide a closure member that is more robust and less subject to being twisted, bent, and/or unacceptably deformed at its pivot (35, FIG. 1) when in an opened condition. Improvements are also desired to eliminate the need for a separate loading apparatus as seen in FIGS. 3 and 4 of the Brown '052 patent.

Gaidos U.S. Pat. No. 1,797,951 discloses a firearm magazine with a flat sliding plate for closing a side of its magazine chamber. However, it includes a slidably mounted latch sensitive to dirt and debris adversely affecting its operation. Also, the plate has slots machined along its edges for slidingly engaging inwardly-deformed edges of the magazine member. The slots are expensive to machine, and further the slots form a narrow track that may trap dirt and debris adversely affecting slidability of the plate, especially when the magazine is being loaded in dirty environments. Gaidos, like Brown, also discloses an open slot along its length that potentially allows debris to enter the magazine, thus greatly reducing its resistance to intrusion of debris. Also, a pull ring protrudes from an end of the plate and, along with the latch, is subject to getting caught on objects when manipulating the magazine.

Kim U.S. Pat. No. 4,688,344 discloses a separate loading apparatus that contains the ammunition for insertion into the magazine. This design is overly complex and uses many extra parts that would be cumbersome to carry or use. The process needed to load a magazine with this design is also more tedious than the conventional one-by-one loading method.

Guy et al. Patent Application Publication No. 2005/0081421 A1 discloses a "Heavy Duty Magazine Loader" that again requires the loading of a shell loader prior to loading the magazine itself. This design requires a multitude of heavy parts for its construction. The design of this loader is bulky, overweight, and is far from portable. It also does not allow for the loading of a magazine where the ammunition is inserted on an angle, such as most semi-automatic handgun magazines.

Ball U.S. Pat. No. 2,862,324 discloses a "Clip Slide Depressor." This is yet another separate item that has to be carried by the user. The user's hands could just as easily accomplish the function that this design performs. This concept arguably offers no real advantage to loading a magazine.

Herpel Patent Application Publication No. US 2005/0150148 A1 discloses a magazine having a cord attached to the follower for pulling the follower toward the base to relieve the spring tension that would otherwise oppose the force of inserting ammunition. This concept requires the use of a ring at the bottom of the cord that remains extended from the magazine housing when the magazine is filled with ammunition. The cord and ring could easily be caught on objects while the magazine is dispensing the ammunition into the firearm, hence jeopardizing the critical function of the magazine's dispensing action. The cord also has the possibility of becoming tangled with the inner workings of the magazine, hence jeopardizing the function of the magazine. This concept also allows for the possibility that a round of ammunition could be inserted in the correct direction, but tumble while falling to the bottom and landing in the wrong direction.

Urchek Patent Application Publication No. 2003/004684 A1 discloses yet another complicated loading apparatus that is a separate item to have to carry. This concept would also only work with rim fire type ammunition where the ridge on the rear of the ammunition is larger than its cylindrical casing.

Phillips U.S. Pat. No. 6,807,764 B1 discloses an object similar to that of the Ball U.S. Pat. No. 2,862,324. This is yet another separate item that has to be carried by the user. The user's hands could just as easily accomplish the function that this design performs. This concept arguably offers no real advantage to loading a magazine.

Pikula U.S. Pat. No. 6,687,985 B2 discloses a magazine-loading tray. This concept has little, if any, advantage over conventional one-by-one loading. The tray must be loaded, then the magazine must be loaded using the tray, providing no clear advantage to the user. This design is also quite bulky and would not be very portable.

To summarize, the present inventors believe that the above patent references, along with other similar designs, are either overly complex, bulky, or non-portable. None of these concepts provide a sound solution to the cumbersome task of loading ammunition. Some, in fact, add to the burden.

Thus, a system is desired having the aforementioned advantages and solving the aforementioned problems.

SUMMARY OF THE PRESENT INVENTION

In one aspect of the present invention, an apparatus is provided for storing cartridges for a firearm, with each cartridge including a hollow shell carrying a bullet at a first end thereof and having a circular bottom at an opposite second end thereof. The apparatus includes a magazine having an elongated containing body and a closure member defining a cavity adapted to receive and hold cartridges. The closure member is longitudinally slidably mounted on the containing body for telescoping movement between an extended position that opens a side of the containing body to allow cartridges to be loaded into the containing body and a closed position where the cartridges are retained within the containing body. The closure member has opposing sidewalls forming an integral handle surface that can be grasped to slide the closure member longitudinally to the extended position for loading cartridges into the containing body and to the closed position for retaining the cartridges therein.

In a narrower form, the containing body defines a first cavity and the closure member defines a second cavity that when combined are sufficient to receive and contain the cartridges, but where the first cavity is shorter than a length of the cartridges such that a portion of the bullet extends above the first cavity, which facilitates loading and positioning cartridges in the first cavity prior to closing the cover. In a still narrower form, the containing body and the closure member each have a C-shaped cross section, with the closure member forming at least 10% of the cartridge-storing cavity.

In a narrower form, the containing body and closure member provide a fully enclosed cavity for holding the cartridges, which provides a cavity resistance to intrusion by the dirt and debris.

In a narrower form, the containing body and closure member are both designed with features integrally formed in the material.

In another aspect of the present invention, an apparatus includes a magazine with an elongated containing body and a closure member. The closure member is longitudinally slidably mounted on the containing body for telescoping movement between an extended position that opens a side of the containing body to allow cartridges to be loaded into the containing body and a closed position where the cartridges are retained within the containing body. The containing body has an open end adapted to present cartridges to a firearm and has a closed end. A follower is operably mounted in the containing body and includes a shell-engaging member. A spring biases the follower toward the open end of the magazine. The closure member includes a flange for moving the follower toward the closed end when the closure member is moved to the extended position. A latch is positioned within the containing body near the closed end for engaging the follower to hold the follower in a cartridge-loading position with the spring compressed so that cartridges can be loaded without interference from the follower. A release is provided on the closure member that automatically releases the follower and hence allows the spring to expand when the closure member is moved to the closed position so that the follower biases the cartridges in the magazine toward the open end when the closure member is closed.

In another aspect of the present invention, an apparatus includes a magazine with an elongated containing body and a closure member each formed from sheet material. The containing body and closure member each have opposing side walls with overlapping edge flanges. The overlapping flanges on each side of the containing body form a track and a track-engaging slide, such that the closure member is longitudinally slidable to an extended position on the containing body for loading cartridges and further is longitudinally slidable to a closed position for retaining the cartridges in the containing body.

In another aspect of the present invention, an apparatus includes a magazine with an elongated containing body and a closure member, the closure member being operably mounted on the containing body for movement between a cartridge-loading position opening a side of the containing body for permitting cartridges to be loaded into the containing body and a closed position where the cartridges are retained within the containing body. The magazine includes a follower and spring adapted to press bullets toward an open end of the containing body. The containing body includes a hook for engaging the follower to temporarily retain the follower in a non-use position, and the closure member includes a release. The hook engages the follower and holds the follower in the non-use position when the closure member is moved to the open position, but the release abuts the hook and automatically disengages the hook from follower when the closure member is moved to the closed position.

In another aspect of the present invention, a method of loading cartridges into a magazine comprises steps of providing a magazine including an elongated containing body and a closure member defining a cavity adapted to receive and hold cartridges, the closure member including side walls that partially define the cavity. The method further includes grasping sidewalls of the closure member and longitudinally sliding the closure member on the containing body to an extended position that opens a side of the containing body to allow cartridges to be loaded into the containing body, loading cartridges into the containing body, and grasping sidewalls of the closure member and longitudinally sliding the closure member to a closed position where the cartridges are retained within the containing body.

In yet another aspect of the present invention, a method of loading cartridges into a magazine comprises steps of providing a magazine with an elongated containing body and a closure member, the closure member being longitudinally slidably mounted on the containing body for telescoping movement between an extended position that opens a side of the containing body to allow cartridges to be loaded into the containing body and a closed position where the cartridges are retained within the containing body, the containing body having an open end adapted to present cartridges to a firearm and having a closed end, a follower operably mounted in the containing body and including a shell-engaging member, a spring biasing the follower toward the open end of the magazine. The method further includes longitudinally sliding the closure member to the extended position and simultaneously moving the follower toward the closed end by engaging a flange on the closure member with the follower when the closure member is moved to the extended position. The method still further includes providing a latch within the containing body near the closed end. The method includes engaging the follower when the closure member is moved to the extended position to hold the follower in a cartridge-loading position with the spring compressed so that cartridges can be loaded without interference from the follower. A release is provided on the closure member adapted to engage and release the latch when the closure member is moved to the closed position. The method includes automatically releasing the follower and hence allowing the spring to expand when the closure member is moved to the closed position so that the follower biases the cartridges in the magazine toward the open end when the closure member is closed.

This firearm magazine is designed to improve upon the conventional design of a firearm magazine where ammunition is inserted one-by-one through its mouth. In traditional magazines, a spring, opposing the direction of insertion pressure applied, must be depressed in order to insert the ammunition. The opposing pressure of the spring becomes increasingly greater for each inserted round of ammunition. This can cause stress on the fingers of the individual loading the magazine and cause the loading of an entire magazine to become extremely time consuming. It is an object of the present invention to allow for the loading of rounds of ammunition with no resistance from the opposing spring, and a wider, less restrictive opening to insert the ammunition. It also allows for rapid unloading of the ammunition.

An object of the present invention is to provide an improved, easily-loading, fast-loading, dirt-resistant magazine for firearms, such as automatic and semi-automatic rifles (e.g., Uzi, M16, and AK47 rifles), handguns, and other firearms utilizing a magazine for loading or dispensing ammunition Another object of the present invention is to provide for very quick and easy unloading of bullets, such as when a few cartridges remain in the magazine and unloading ammunition, one bullet at a time, is slow, time-consuming, and unnecessarily manually extensive.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
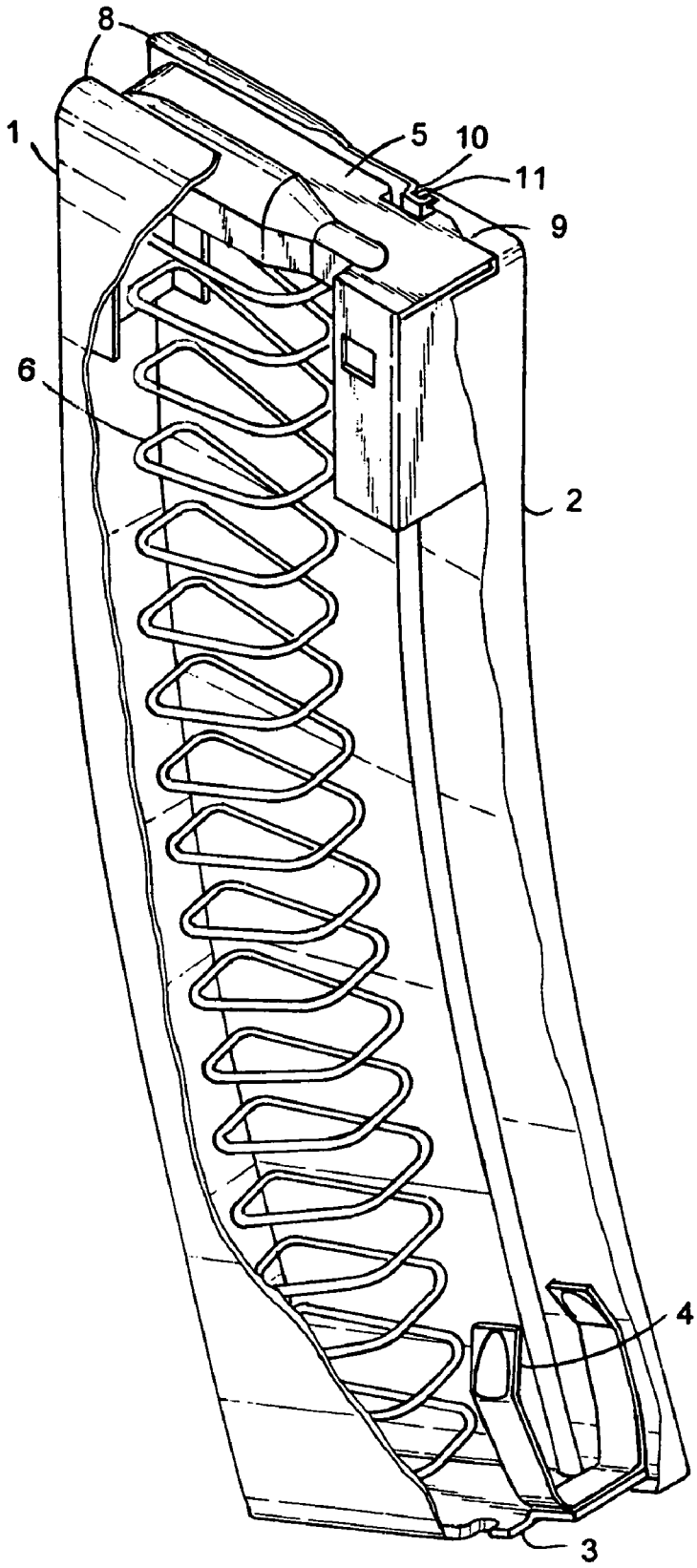
FIG. 1 is a perspective view of the present magazine, including a containing body and a longitudinally-slidably extendable closure member, the closure member being in a closed position.

The present magazine accomplishes improved functions by separating the illustrated magazine into two portions including the containing body (1) and the closure member (2) (also called an "opening body" or "cover" herein). The two portions are held together on each side by a slide rail (10/11) on each side. The slide rail 10/11 is formed by mating flanges formed on edges of the overlapping side walls, forming a track and slide arrangement, as described below. Advantageously, the side walls of the closure member (2) are sufficient in size to form a handle-like surface on the closure member (2) that can be grasped, allowing the closure member (2) to be gripped and moved to an open position without the need for a separate handle or protruding tab or ring.

The illustrated slide rail (10/11) consists of interlocking shapes. For example, the containing body (1) including a female indent or outwardly facing groove or track (10) along its entire edge at the separation, and the closure member (2) includes a male lip or slide (11) formed along the entire edge of the separation that slidably engages the track. Notably, the groove is slightly dished, reducing its tendency to collect dirt and debris. When the closure member (2) is in a closed position on the containing body (1), and the magazine has no ammunition inserted, the follower spring (6) forces the follower (5) to a top of the magazine near the open end of the containing body (1) (see FIGS. 1 and 1A). The follower (5) is held inside of the magazine assembly by the feed lips or flanges (8), and the follower catch points (9). The follower spring (6) is held in by the base plate (3), which is connected to the bottom of the containing body (1). The base plate (3) is narrow enough on the portion below the closure member (2) to allow for the passing of the closure member (2). The closure member (2) cannot move beyond the fully open or fully closed position due to formation of end flanges on the bodies (1) and (2).

Figure 6:
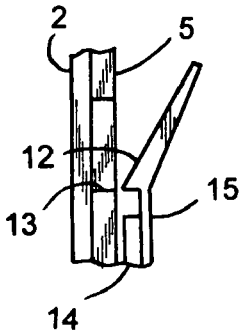
FIG. 6 is an enlarged view of the circled area in FIG. 5.
Figure 5:
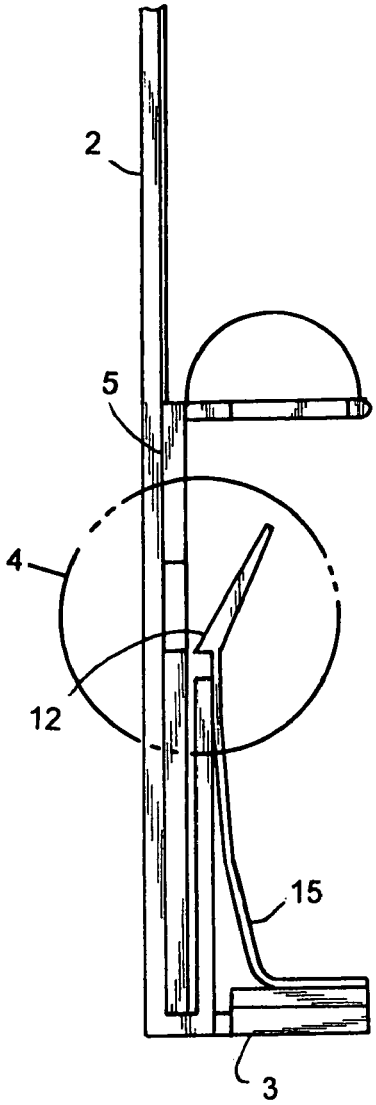
FIG. 5 is a cross section taken along the line V-V in FIG. 3. (i.e. the open position)
Figure 4:
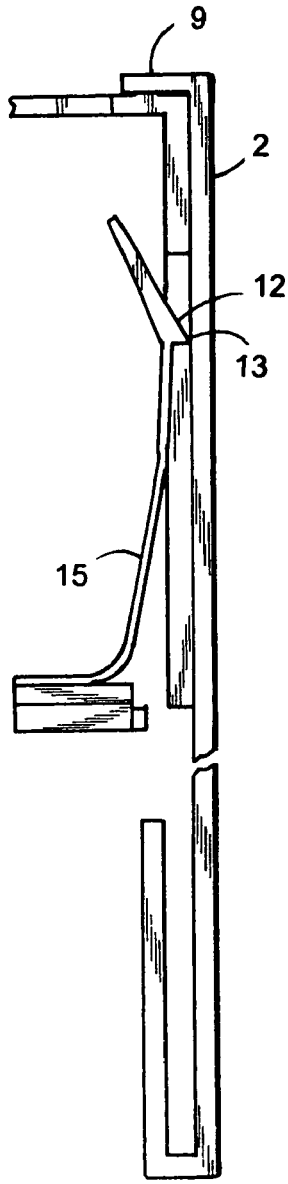
FIG. 4 is a cross section taken along the line IV-IV in FIG. 2 (i.e. the closed position).

When the closure member (2) is pulled back to its open position (FIG. 2), the follower catch points (9) pull the follower (5) with it, hence compressing the follower spring (6) between the follower (5) and the base plate (3). This also opens the inside of the containing body (1). The follower spring (6) is kept compressed by a latching mechanism (4). In this example, the latching mechanism (4) consists of spring metal (15) with hooks (12) at each end of resilient arms. The spring (15) is bent appropriately to cause each hook (12) to engage mating apertures (13) (FIG. 4 or 6) in the follower (5) when the closure member (2) is in the extended or open position. This metal spring (15) is attached to the base plate (3) at a raised location inside of the closure member (2). In the illustrated example, the closure member (2) includes two vertically pointing tabs that force the hooks (12) inward, thus causing the latch to release when the closure member (2) is returned to its fully closed position (see FIGS. 1 and 5).

Figure 1A:
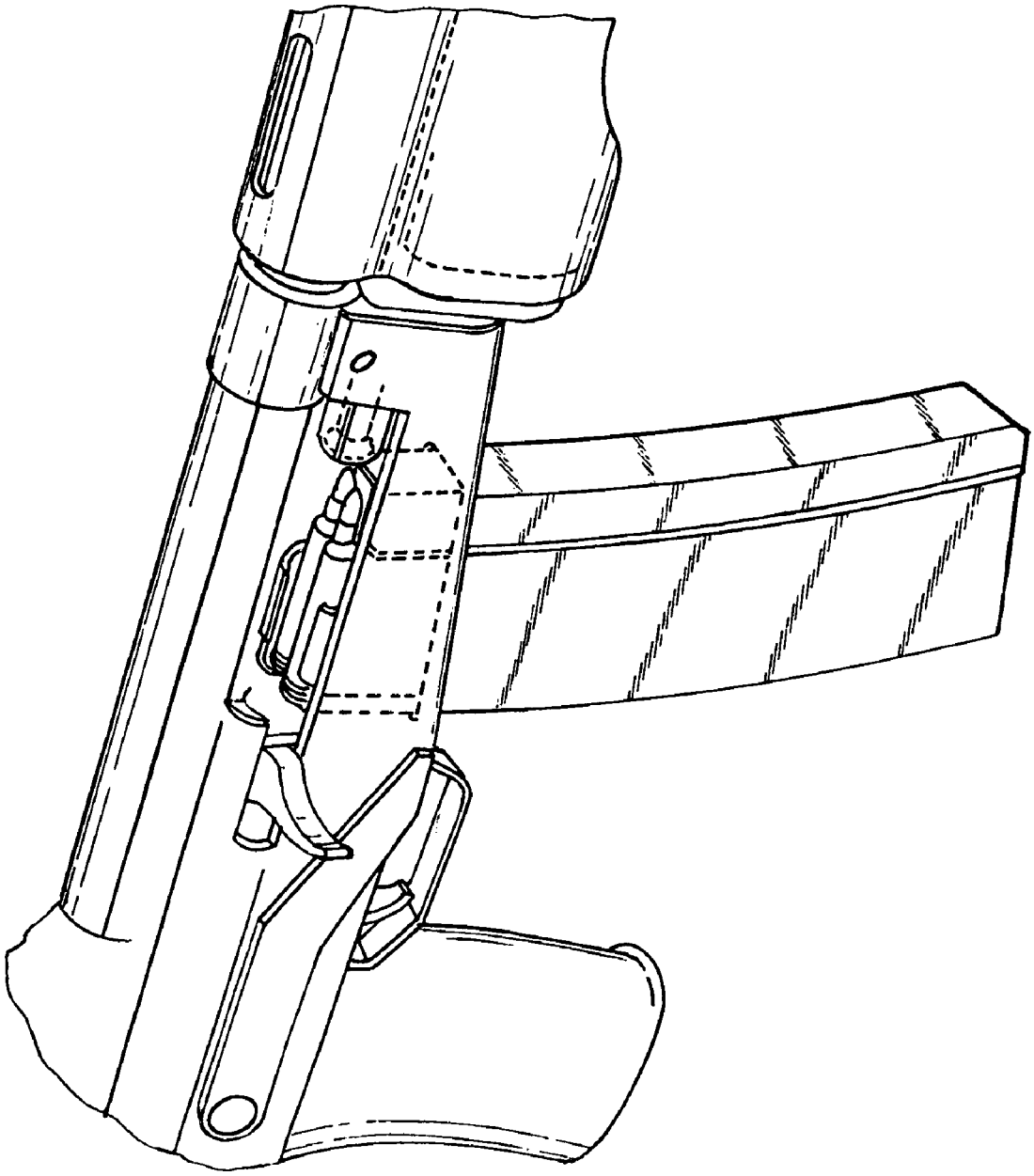
FIG. 1A is a perspective view of the magazine of FIG. 1 on a firearm.
Figure 2:
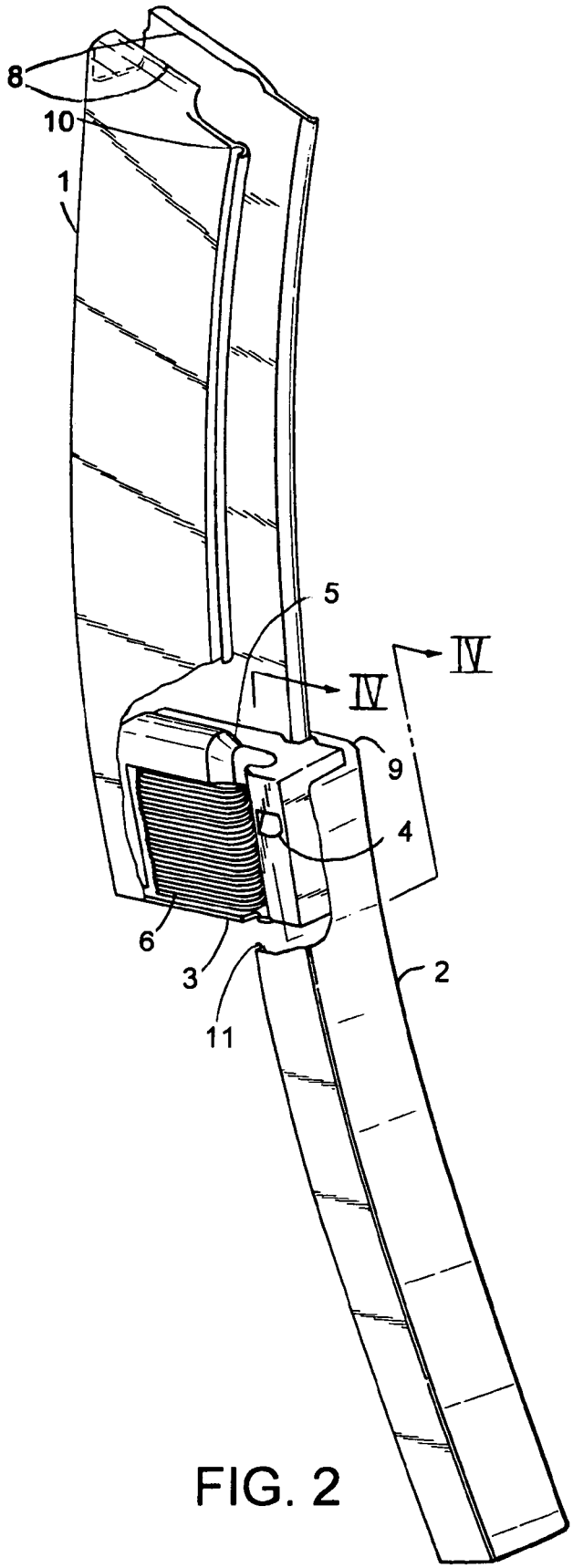
FIG. 2 is a perspective view of the magazine of FIG. 1 with the closure member in an extended (open) position.
Figure 3:
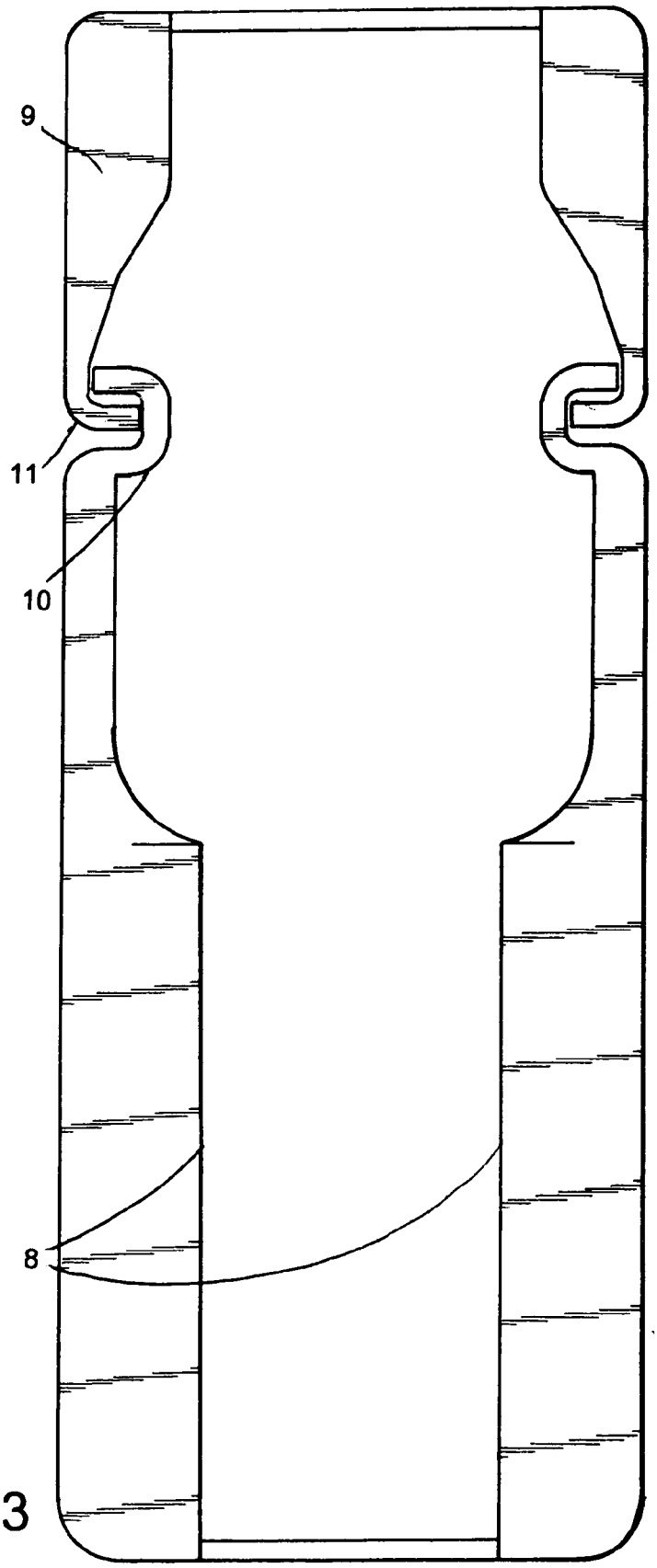
FIG. 3 is a view of the open end of the containing body and closure member of FIG. 1.

To summarize, once the closure member (2) is pulled back and locked in its open position (FIG. 2), the rounds of ammunition can be inserted into the containing body (1) with no resistance from the follower spring (6). Once the ammunition has been loaded into the containing body (1), the closure member (2) can be slid forward to its closed position enclosing the ammunition (FIG. 1). As soon as the closure member (2) is returned to its fully closed position, the follower (5) is released by engagement of a release tab (14) on the containing body (1) near the closed end of the containing body (1), allowing the spring (6) to press the follower (5) against the ammunition and towards the top opening of the magazine. The ammunition is held in by the feed lips (8), which match those of a conventional magazine in order to keep the rounds of ammunition in position for reliable dispensing into the firearm. Performing the reverse operation can unload the ammunition. Pulling the closure member (2) to the locked back position would compress the spring allowing the ammunition to be "dumped" out. Preferably the closure member (2) forms at least about 10% of the cavity for the cartridge, so that the side surface of the closure member (2) is sufficient in size to be easily grasped. However, by having the closure member form about 25% of the cavity, the size of the opposing walls are increased for better grasping. Also, the containing body (1) becomes an open cavity for easy insertion of ammunition.

Advantageously, the present preferred embodiment includes relatively few parts and many integrally formed features. For example, it does not require additional or "extra" parts to compress and retain the cartridge-biasing spring. Instead, the design of the magazine body contains all of the features required to open the magazine and compress the spring, but with minimal parts rather than additional parts as seen in U.S. Pat. Nos. 1,747,451; 4,814,052; or 4,688,344.

The slide rails allowing the magazine to open are integrally formed as part of the containing body itself. This construction is not only unique, but it advantageously adds additional strength to the overall magazine rather than reducing the strength. Further, the telescoping extension of the closure member (2) positions it at an unobtrusive, non-interfering position when loading cartridges into the containing body (1). Also, it is significant that the present slide/rail system provides a strong connection between the two halves along the entire length of the magazine (instead of depending on the strength of one hinge pin as seen in U.S. Pat. No. 4,614,052). Because of the added strength, there is no need to use alternative materials to form the bodies (1) and (2), hence allowing for unaltered dimensions to that of a relative conventional magazine design.

Advantageously, in the present design, the basic shape of the critical top opening is not altered when the magazine is in its closed position since the slide rail is built within the dimensions of a conventional magazine. This allows for equal or greater reliability to a conventional magazine.

Advantageously, there are no extra or "exposed" openings or slots in the present magazine when it is attached to a firearm, thus providing resistance to intrusion of debris. This is very important for firearms used in dirty environments . . . particularly for automatic firearms where reloading must be done more frequently and sometimes with urgency. Advantageously, both the magazine and the loader are incorporated into one single unit to replace the need for extra items to carry. Notably, this design also allows for easy unloading as well as loading. Further, it is noted that, in the present design, the number of rounds that can be loaded at one time is only restricted by the size of the magazine, not the size of the loader. By the present arrangement, rounds can be directly loaded into the magazine instead of loading the loader and then the magazine, making the entire process one step faster. Also, any unfired rounds remaining in the magazine can be dumped with one easy motion by merely opening the closure member (2). In other words, the unspent rounds do not have to be removed one at a time, which is slow, time-consuming, and unnecessarily manually intensive. This quick unloading method is believed to be a significant advantage over prior art.

Figure 7:
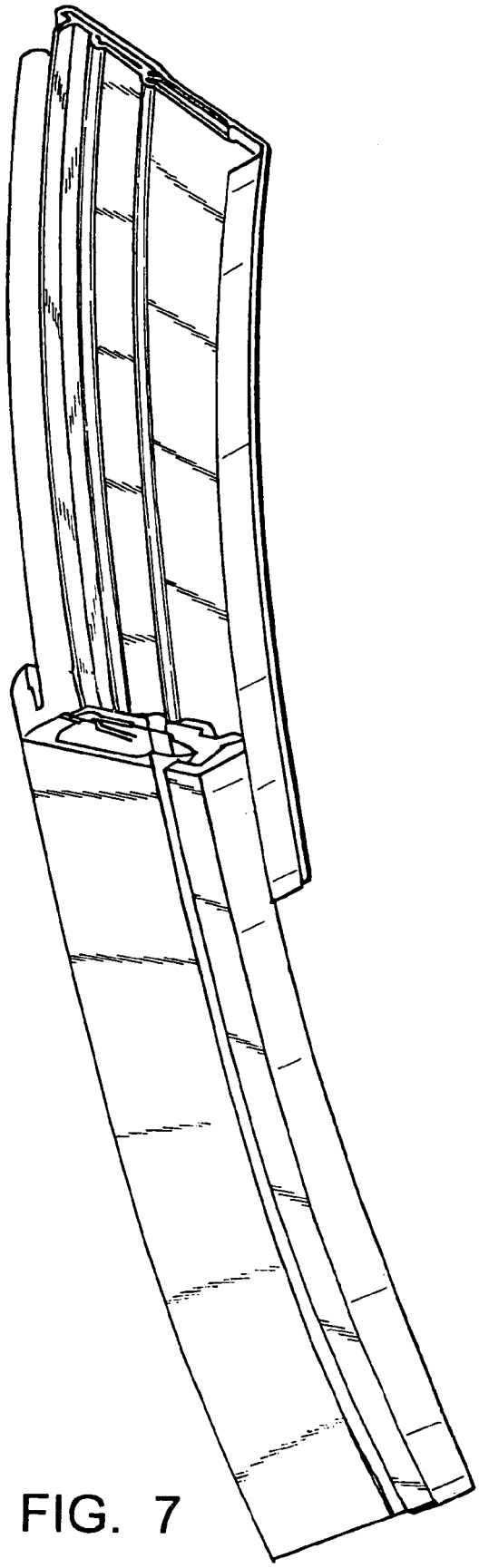
FIG. 7 is a perspective view of an alternative magazine concept with a modified containing body and closure member.
Figure 8:
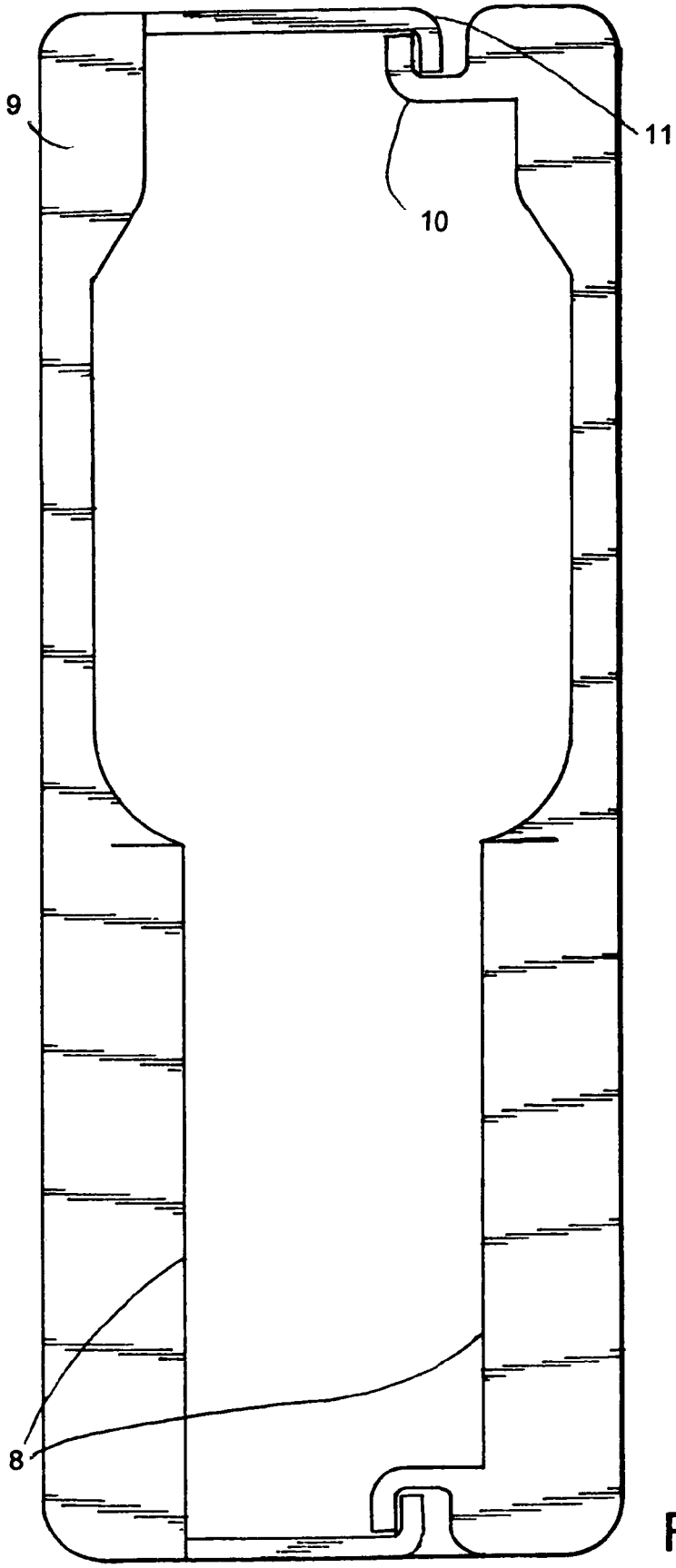
FIG. 8 is a view of the open end of the containing body and closure member in FIG. 7 (similar to FIG. 3).

It is contemplated that a scope of the present invention includes other possibilities of performing the function of this magazine. For example, it is contemplated that aspects of the present invention can still be used even if the closure member is connected to the containing body by a pivot or hinge (instead of telescopingly slidable). Also, the closure member (2) could be designed to open on the side (see FIGS. 7-8). The given example of FIG. 1 shows the follower catch points (9) located on the top of the closure member (2). It is contemplated that variations of this could be constructed to include different types of catch points inside of the magazine that come in contact with the follower (5) or follower spring (6), or could include a separate piece that compresses the follower spring (6). It is also contemplated that the locking mechanism (4) could be constructed in other configurations. The present example shows a locking mechanism (4) that latches onto the follower (5). Some examples of possible variations to the locking mechanism (4) could be a lock that grabs onto the closure member (2), a lock that is activated or deactivated by a push button or lever, a friction point or latch in the slide rail (10/11) that stops the closure member from closing or opening unintentionally, or any other design that allows for locking and releasing the action of the closure member (2). It is also possible that the function of the locking mechanism (4) could be performed by the user simply by holding the closure member (2) back, or any design that would naturally lock the action back until the closure member (2) is forced to its closed position.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An apparatus for storing cartridges for a firearm, with each cartridge including a hollow shell carrying a bullet at a first end thereof and having a circular bottom at an opposite second end thereof, comprising:

a magazine including an elongated containing body and a closure member defining a cavity adapted to receive and hold cartridges, the closure member being longitudinally slidably mounted on the containing body for longitudinal sliding movement between an extended position that opens a side of the containing body to allow cartridges to be loaded into the containing body and a closed position where the cartridges are retained within the containing body, the closure member having opposing sidewalls and a transverse wall defining a C-shaped cross section forming an integral handle surface that can be grasp to slide the closure member longitudinally to the extended position for loading cartridges into the containing body and to the closed position for retaining the cartridges therein, wherein the closure member is longitudinally curved, and wherein the sidewalls and transverse wall define at least about 10% of the cavity and further define a three dimensional surface for receiving a user's hand while the user grips the sidewalls with their thumb and fingers to facilitate the longitudinal sliding movement, and further wherein the containing body and the closure member include formed overlapping flanges that form a track and further that strength the containing body and the closure member and further that sealingly engage each other and do not include uncovered openings when in the closed position upon attachment to a firearm such that the magazine is resistant to dust intrusion when attached to the firearm.

2. The apparatus defined in claim 1, wherein the containing body has a C-shaped cross section.

3. The apparatus defined in claim 1, wherein the containing body defines a first cavity and the closure member defines a second cavity that when combined are sufficient to receive and contain the cartridges, the first cavity being shorter than a length of the cartridges such that a portion of the bullet extends above the first cavity, which facilitates loading and positioning cartridges in the first cavity prior to closing the closure member.

4. The apparatus defined in claim 1, wherein the containing body includes second side walls and a second transverse wall and wherein the containing body and the closure member characteristically do not include additional exposed openings in their respective side walls permitting intrusion of dirt and debris into the cavity.

5. The apparatus defined in claim 1, wherein the magazine does not include a separate handle, pin or ring that protrudes from an outer surface of the containing body nor the closure member.

6. The apparatus defined in claim 1, including a spring-biased follower in the containing body that is adapted to bias cartridges toward an open end of the containing body, and including a latching mechanism adapted to hold the follower in a remote position away from the open end to facilitate loading of cartridges, the latching mechanism being configured to automatically release the follower when the closure member is moved to the close position.

7. The apparatus defined in claim 6, wherein the latching mechanism includes a spring.

8. The apparatus defined in claim 6, wherein the latching mechanism includes a pair of spring-biased hooks that engage opposing apertures in the follower, containing body, or closure member when the closure member is in the extended position, and including a release with a pair of release tabs that abut and disengage the hooks when the closure member is moved to the closed position.

9. The apparatus defined in claim 6, wherein all of the latching mechanism is positioned inside of the cavity defined by the containing body and the closure member.

10. The apparatus defined in claim 1, wherein the overlapping flanges define an outwardly-facing groove and the closure member defining slides that slidably engage the grooves for longitudinal sliding movement, the overlapping flanges each including a constant wall thickness and extending a majority of a length of the respective containing body and the closure member and further being longitudinally curved and shaped to strengthen the containing body and the closure member.

11. An apparatus for storing cartridges for a firearm with each cartridge including a hollow shell carrying a bullet at a first end thereof and having a circular bottom at an opposite second end thereof, comprising:

a magazine with an elongated one-piece containing body and a one-piece closure member combining to completely define a cavity and shaped and adapted to hold cartridges for a firearm, the closure member being longitudinally slidably mounted on the containing body for longitudinal sliding movement between an extended position that opens a side of the containing body to allow the cartridges to be loaded into the containing body and a closed position where the cartridges are retained within the containing body, the containing body having an open end adapted to present the cartridges to the firearm and having a closed end, a shell-engaging follower operably mounted in the containing body, a spring biasing the follower toward the open end of the magazine, the closure member including a flange for moving the follower toward the closed end when the closure member is moved to the extended position, a latch within the containing body near the closed end for engaging the follower to hold the follower in a cartridge-loading position with the spring compressed so that cartridges can be loaded without interference from the follower, a release on the closure member that automatically releases the follower and hence allows the spring to expand when the closure member is moved to the closed position so that the follower biases the cartridges in the magazine toward the open end when the closure member is closed, the follower, the spring, the latch and the release all being positioned entirely within the cavity; the containing body and the closure member sealingly engaging each other when in the closed position and not including uncovered openings when attached to a firearm such that the magazine is resistant to dust intrusion when attached to the firearm.

12. An apparatus for storing cartridges for a firearm with each cartridge including a hollow shell carrying a bullet at a first end thereof and having a circular bottom at an opposite second end thereof, comprising:

a magazine with an elongated containing body and a closure member each being U-shaped and each formed from sheet material or plastic, the containing body and closure member each having opposing side walls with overlapping in edge flanges extending a majority of a length of the containing body and the closure member, the overlapping flanges on each side of the containing body and the closure member being laterally formed and longitudinally curved to add significant strength to the containing body and to the closure member and also forming a curved track and an interlocking track-engaging slide that is sealed along its length when in a closed position, such that the closure member is longitudinally slidable to an extended position on the containing body for loading cartridges and further is longitudinally slidable to the closed position for retaining the cartridges in the containing body.

13. The apparatus defined in claim 12, wherein the track is dish-shaped to reduce a risk of trapping dirt and debris therein.

14. An apparatus for storing cartridges for a firearm with each cartridge including a cylindrical shell carrying a bullet at a first end thereof and having a circular bottom at an opposite second end thereof, comprising:

a magazine with an elongated containing body and a closure member each being U-shaped, the closure member being operably mounted on the containing body for movement between a cartridge-loading position opening a side of the containing body for permitting cartridges to be loaded into the containing body and a closed position where the cartridges are retained within the containing body, the magazine further including a spring-biased follower adapted to press bullets toward an open end of the containing body, the containing body including a U-shaped spring with opposing arms each having at least one hook for engaging a mating pair of apertures in the follower for temporarily retaining the follower in a non-use position, and the closure member including a release comprising release tabs that can be extended under the hooks to release the hooks from the respective apertures, the hooks engaging the apertures of the follower and holding the follower in the non-use position when the closure member is moved to the open position, and the release tabs of the release abutting the hooks and automatically disengaging the hooks from follower when the closure member is moved to the closed position.

15. The apparatus defined in claim 14, wherein the closure member is longitudinally slidable on the containing body.

16. The apparatus defined in claim 14, including a spring biasing the hooks in one direction but the release overcoming the spring when the closure member is in the closed position.

17. A method of loading cartridges into a magazine comprising steps of:

providing a magazine including an elongated containing body and a closure member defining a cavity adapted to receive and hold cartridges, the closure member including side walls and a transverse wall that define at least about 10% of the cavity, the containing body and the closure member including overlapping flanges each including a constant wall thickness and extending a majority of a length of the respective containing body and the closure member and further being shaped to strengthen the containing body and the closure member;

placing a user's hand on the transverse wall and grasping opposing sidewalls of the closure member and further grasping the containing body and thereafter longitudinally sliding the closure member on the containing body to an extended position that opens a side of the containing body to allow cartridges to be loaded into the containing body;

loading cartridges into the containing body; and placing the user's hand on the transverse wall and grasping opposing sidewalls of the closure member and further grasping the containing body and thereafter longitudinally sliding the closure member to a closed position where the cartridges are retained within the containing body.

18. A method of loading cartridges into a magazine comprising steps of:

providing a magazine with an elongated containing body and a closure member, the closure member being longitudinally slidably mounted on the containing body for telescoping movement between an extended position that opens a side of the containing body to allow cartridges to be loaded into the containing body and a closed position where the cartridges are retained within the containing body, the containing body having an open end adapted to present cartridges to a firearm and having a closed end, and a shell-engaging follower operably mounted in the containing body, a spring biasing the follower toward the open end of the magazine;

longitudinally sliding the closure member to the extended position and simultaneously moving the follower toward the closed end by engaging a flange on the closure member with the follower when the closure member is moved to the extended position, providing a latch within the containing body near the closed end, the latch including a U-shaped spring retainer with opposing arms each having at least one hook for engaging a mating pair of apertures in the follower for temporarily retaining the follower in a non-use position, and the closure member including a release comprising release tabs that can be extended under the hooks to release the hooks from the respective apertures;

engaging hooks of the latch with the apertures in the follower when the closure member is moved to the extended position to hold the follower in a cartridge-loading position with the spring compressed so that cartridges can be loaded without interference from the follower; and moving the closure member which causes the release tabs to automatically release the hooks from the follower and hence allowing the spring to expand when the closure member is moved to the closed position so that the follower biases the cartridges in the magazine toward the open end when the closure member is closed.

19. An apparatus for storing cartridges for a firearm, with each cartridge including a hollow shell carrying a bullet at a first end thereof and having a circular bottom at an opposite second end thereof, comprising:

a magazine including an elongated containing body and a closure member defining a cavity adapted to receive and hold cartridges, the closure member being longitudinally slidably mounted on the containing body for telescoping movement along an arcuate path between an extended position that opens a side of the containing body to allow cartridges to be loaded into the containing body and a closed position where the cartridges are retained within the containing body, the closure member having opposing sidewalls forming an integral handle surface that can be grasp to slide the closure member longitudinally to the extended position for loading cartridges into the containing body and to the closed position for retaining the cartridges therein, the containing body and the closure member each having a U-shaped cross section and having longitudinally-curved laterally-formed edges along a majority of their length that interlockingly sliding engage and that are longitudinally curved to define an arcuate track for providing the longitudinal movement, the formed edges both forming the track and also strengthening the containing body and the closure member.

* * * * *